US005110310A

United States Patent [19]

Hobbs

[11] Patent Number: 5,110,310

[45] Date of Patent: May 5, 1992

[54] AUTOMATIC SPEED CONTROL SYSTEM FOR BOATS

[75] Inventor: James V. Hobbs, Bethesda, Md.

[73] Assignee: Lakeland Engineering Corporation, Bethesda, Md.

[21] Appl. No.: 691,122

[22] Filed: Apr. 25, 1991

[51] Int. Cl.[5] ..... B63H 19/00

[52] U.S. Cl. ..... 440/1; 114/253; 440/87

[58] Field of Search ..... 440/1, 2, 87, 113; 114/242, 253, 254; 361/236, 239, 242; 73/182, 183, 488, 502, 509, 510; 364/426.01

[56] References Cited

U.S. PATENT DOCUMENTS 4,759,731 7/1988 Uchida ..... 440/87
4,872,857 10/1989 Newman et al. ..... 440/1
5,074,810 12/1991 Hobbs et al. ..... 440/2

FOREIGN PATENT DOCUMENTS 1756473 8/1970 Fed. Rep. of Germany ..... 440/87
164591 12/1980 Japan ..... 440/1
18595 1/1986 Japan ..... 114/253

*Primary Examiner*—Sherman Basinger

[57] ABSTRACT

An improved apparatus for accurately maintaining the speed of a motorboat at a value set by an operator. Speed of the boat, and force on the boat due to a water skier are measured. Actual speed is compared to a desired speed set by the operator, and speed of the boat engine adjusted to minimize the difference between the desired speed and the actual speed. Engine speed is further adjusted to prevent or minimize changes in the speed of the boat caused by the forces on the boat due to a water skier. The device further incorporates features to reduce the likelihood of speed measurement errors due to a malfunctioning speed measuring device.

7 Claims, 3 Drawing Sheets

AUTOMATIC SPEED CONTROL SYSTEM FOR BOATS

BACKGROUND OF THE INVENTION

1. Field of Art of the Invention

This invention relates to an improved system for automatically maintaining a boat at or very near a speed set by the operator, particularly when the boat is pulling a water skier.

2. Description of the Related Art

An automatic speed control system for boats is described in the patent application of Ser. No. 07/546394, now U.S. Pat. No. 5,074,810. This system maintains the speed of a boat at a value set by the operator by measuring boat speed, comparing this measured speed to the desired speed, and adjusting the throttle of the engine to minimize the difference between the measured speed and the desired speed. For the application of competitive water skiing, however, this system does not always respond quickly enough to compensate for the sudden change in load due to maneuvers by the skier, and therefore cannot always prevent noticeable changes in boat speed resulting from these loads. Additionally, this system can perform erroneously if debris in the water clogs, or partially clogs the Pitot tube used to measure boat speed.

SUMMARY OF THE INVENTION

It is the object of this invention to provide an improved automatic speed control system for boats, which reduces boat speed errors due to sudden changes in loads encountered in pulling water skiers. Another object of this invention is to provide an improved automatic speed control system for boats, which provides a greatly reduced likelihood of improper speed control due to the speed measurement device being rendered erroneous from debris in the water, or for any other reason.

DETAILED DESCRIPTION OF THE INVENTION

Figure 1:
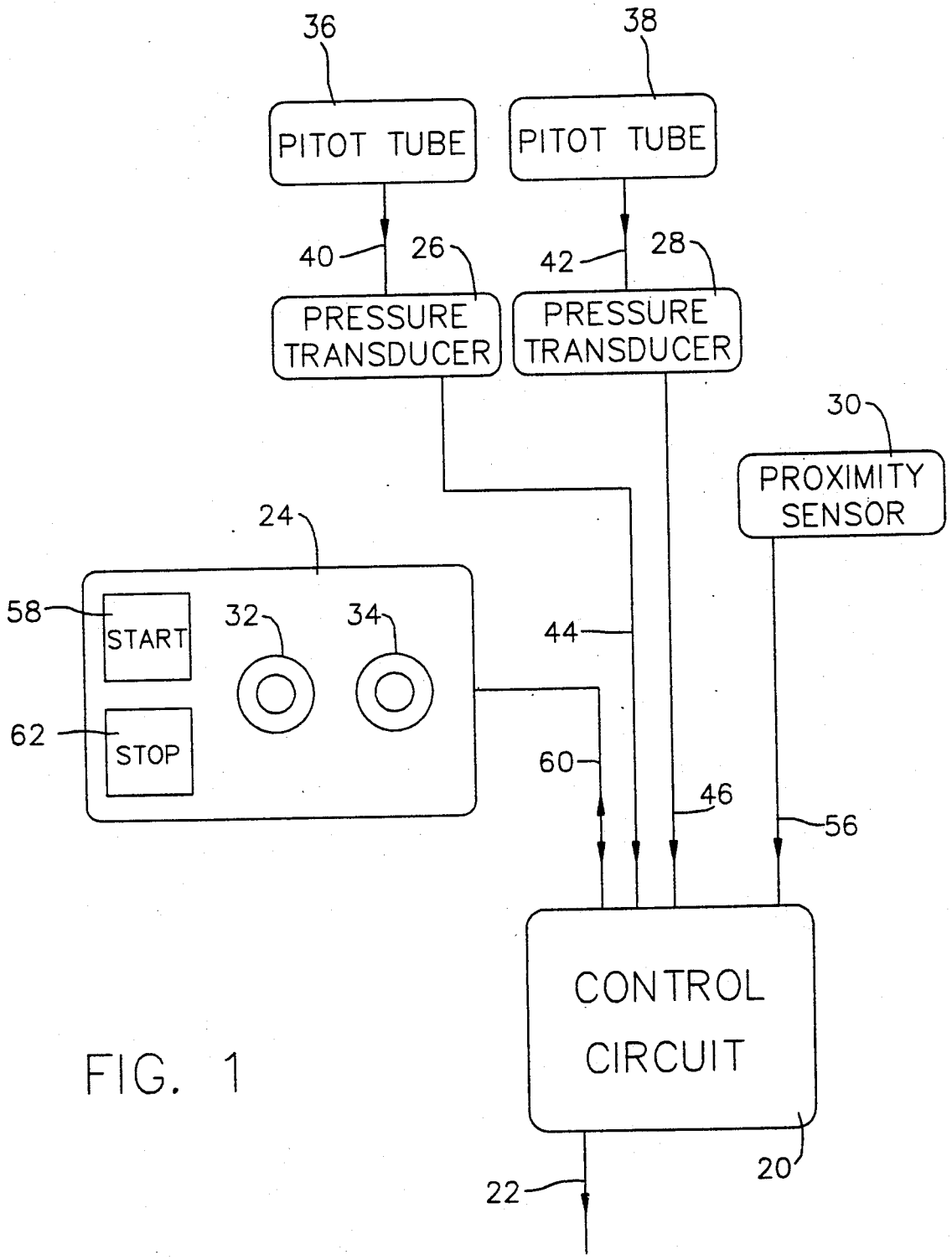
FIG. 1 shows the improved portion of the boat speed control system.
Figure 2:
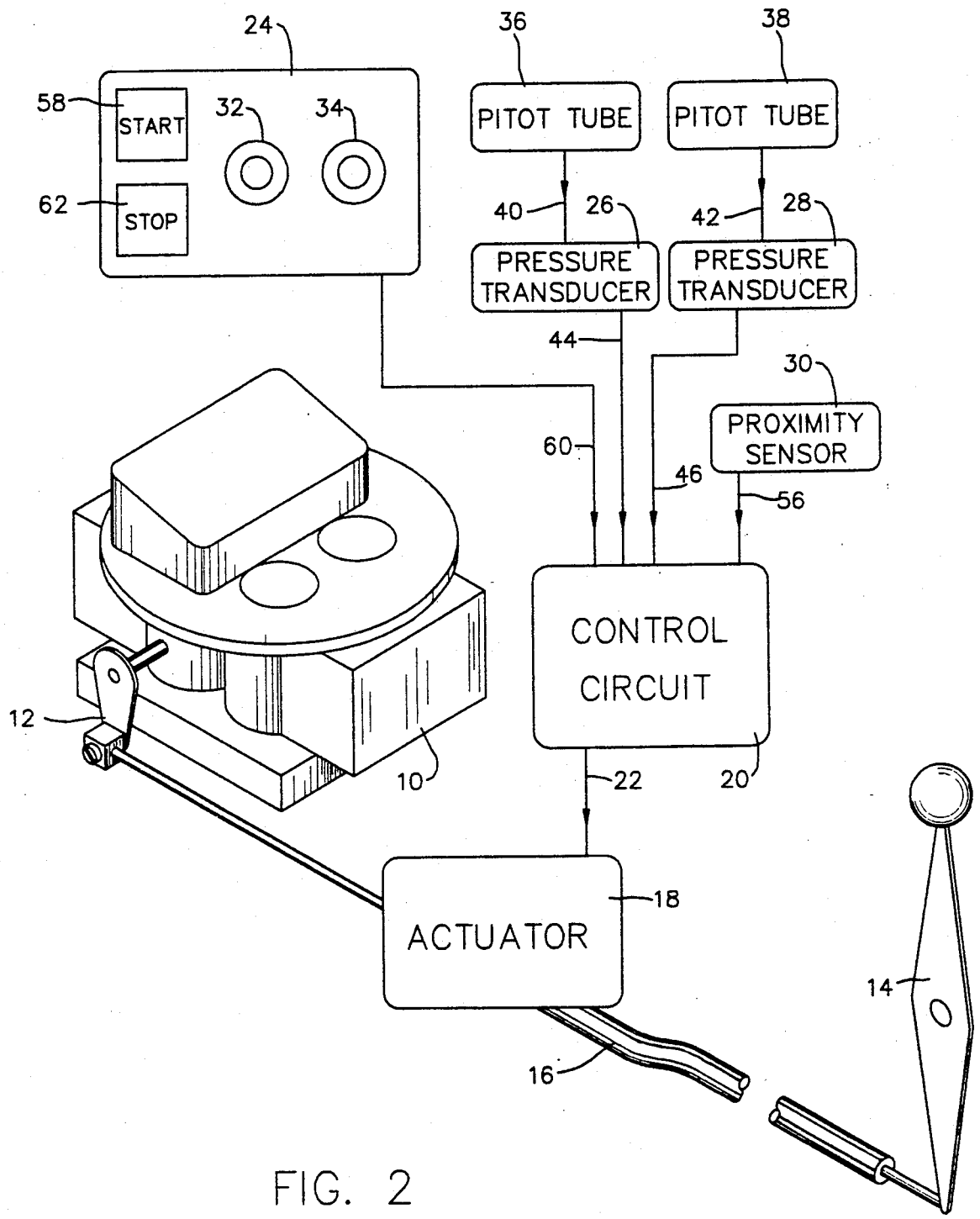
FIG. 2 is a schematic representation of a boat speed control system embodying the present invention.

Referring to FIG. 2, there is a boat engine 10 equipped with an engine throttle lever 12, which is connected to a hand throttle lever 14 by a means such as the well known type called a Bowden cable 16. An actuator 18 causes the engine throttle lever 12 to be displaced in a controlled manner when a source of power such as an electric current is sent to it from the control circuit 20 through actuator cable 22, but otherwise allows normal operation of hand throttle lever 14. This actuator has a limited travel corresponding to a change in position of engine throttle lever 12 which will result in a change of boat speed such as plus or minus five miles per hour. This actuator 18 may be one of many types well known to those having ordinary skill in the art.

The control circuit 20 generally consists of a microprocessor and related input and output devices. One input device reads operator input from keyboard 24, another reads electrical signals from pressure transducers 26 and 28 and another reads the electrical signal from proximity sensor 30. An output device drives actuator 18 when directed to do so by a program controlling the operation of the microprocessor. Another output device drives warning indicators 32 and 34. The program controlling the operation of the microprocessor is contained in a programmable device within control circuit 20, and directs the microprocessor to perform the control functions necessary to the operatio of this invention, in a manner well known to those having ordinary skill in the art.

In accordance with this invention, the speed of the boat is measured by more than one Pitot tube, in this case two Pitot tubes, Pitot tube 36 and Pitot tube 38, which when supported by the structure of the boat and travelling in the water, create a pressure proportional to the square of the boat speed in a well known manner. The pressures developed at Pitot tubes 36 and 38 are carried to pressure transducers 26 and 28 along flexible tubes 40 and 42. The pressure transducers are of a well known type, causing the pressure carried by flexible tubes 40 and 42 to be converted to electrical signals proportional to these pressures. These electrical signals are carried to the control circuit 20 by way of transducer cables 44 and 46.

Figure 3:
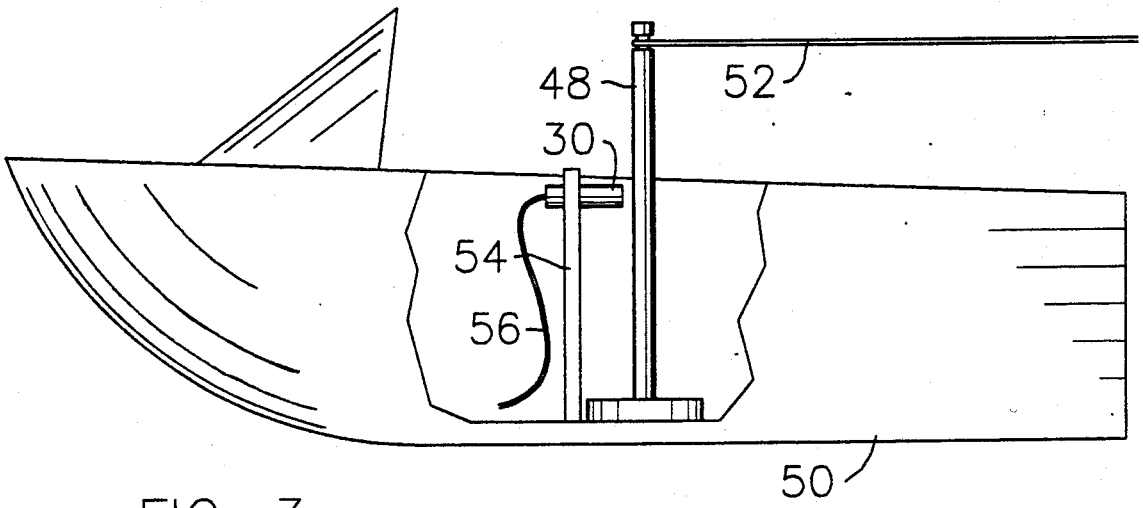
FIG. 3 shows a motorboat with its side cut away, exposing a typical tow pylon, an attached tow rope, and the preferred method of measuring the load on the tow pylon, using a proximity sensor to measure pylon deflection under load.

In addition to measuring the speed of the boat, this invention measures the force acting on the boat applied by a water skier. Referring to FIG. 3, there is a metal pylon 48, rigidly attached to the structure of the boat 50 at its lower end. Attached to the upper end of pylon 48 is tow rope 52, for the purpose of towing a water skier. Proximity sensor 30 produces an electrical signal proportional to its distance from metallic objects in a manner well known to those having ordinary skill in the art. This proximity sensor 30 is rigidly mounted to bracket 54, which is in turn rigidly mounted to the structure of the boat 50 at its lower end. The electrical signal from the proximity sensor 30 is carried to control circuit 20 by proximity sensor cable 56. When a force is applied to the tow rope 52 by a water skier, the force is transmitted to the pylon 48, which bends due to this force, and moves away from the proximity sensor 30. Proximity sensor 30 then changes its electrical output signal by an amount proportional to the change in distance between it and pylon 48, and hence proportional to the force from tow rope 52 acting on the boat 50. When directed to do so by the program controlling its operation, control circuit 20 calculates the force from tow rope 52 acting on boat 50 by subtracting the electrical signal from proximity sensor 30 when no force is acting on pylon 48 from the signal when force is applied to pylon 48.

The operator adjusts the boat speed by the use of hand throttle lever 14 until the speed of the boat is that desired by the operator. The operator then depresses start key 58 of keyboard 24, causing a signal to be sent through keyboard cable 60, in turn causing control circuit 20 to initiate the speed control operation.

Since two or more devices or systems measuring the speed of a boat at the same time are likely to produce slightly different output signals due to normal manufacturing tolerances and other unavoidable differences, the control circuit 20 first normalizes the output of the pressure transducers to the value of the highest output. To do this, control circuit 20 reads the output of both pressure transducers 26 and 28 and substracts the lower of the two readings from the higher reading. The difference is stored, along with information indicating which of the two pressure transducers produced this lower output. During subsequent readings of boat speed, control circuit 20 reads the output of both pressure transducers, 26 and 28, and adds the previously calculated difference to the output of the transducer previously having the lower output. Now the two outputs have been normalized to the higher output, and control circuit 20 compares them to determine which is the higher, without the unavoidable differences between the measuring devices affecting the decision. The higher normalized reading is then used for control purposes. By this method, if either Pitot tube 36 or 38 becomes blocked, causing a lower signal to be sent to the control circuit 20, the control circuit 20 will read only the signal from the functioning Pitot tube and pressure transducer combination, and therefore will be able to determine the correct boat speed as long as at least one such combination is functioning properly. Since errors in the output signal of a Pitot tube and pressure transducer combination nearly always occur in the direction tending to lower the output signal, controlling the boat speed based on the highest of more than one such combination ignores such erroneous readings. To avoid normalizing the output of pressure transducers 26 and 28 when one of the Pitot tubes 36 or 38 is clogged, the initially measured difference in the output signals is compared to a maximum allowable value greater than a reasonable difference expected from properly functioning Pitot tubes and pressure transducers, but less than the difference expected when a Pitot tube is clogged, such as 0.5 volts. If this maximum difference is exceeded, the output from the lower reading pressure transducer is ignored until such time that the system is again started, and the difference is again within the allowable value. Whenever the output of a pressure transducer is ignored because of exceeding the maximum allowable difference, the operator is alerted by warning indicator 32 or 34 on keyboard 24, corresponding to the pressure transducer which produced the low reading. The operator may then elect to stop the boat and correct the problem causing the low reading, or continue, using only the remaining functioning Pitot tube and pressure transducer. This procedure of comparing the difference to a maximum allowable difference minimizes the likelihood of normalizing and using for control purposes the output of a malfunctioning Pitot tube.

As the control circuit 20 reads subsequent speeds from the normalized output of pressure transducers 26 and 28, it determines which of the two is the higher reading, and compares this reading to the previously set desired speed reading. Control circuit 20 then reads the output of proximity sensor 30 and calculates the force on the tow rope 52. The engine throttle lever 12 is then displaced by actuator 18 so as to cause the boat speed to increase or decrease in order to minimize the difference between the measured speed and the desired speed. In addition to this displacement of throttle lever 12 based on boat speed, a displacement to compensate for the force on tow rope 52 is made. Thus, at any given time during the operation of this system, throttle lever 12 is displaced by the sum of the amount needed to compensate for a speed error, and the amount needed to compensate for a force on tow rope 52. This reading of the current speed based on the higher reading pressure transducer, comparison to the desired speed, measurement of tow rope force, and movement of engine throttle lever 12 takes place continuously, or at a rate of sufficient frequency so as to result in the actual speed of the boat closely matching the desired speed under circumstances which would otherwise result in a varying boat speed, and in a manner more accurate than if boat speed were measured alone.

Under some conditions, it may be desireable to operate the system using only input from proximity sensor 30, without reading the output from either pressure transducer 26 or 28, so that the speed of the boat is set and maintained manually, but compensation is automatically made for influences from the varying forces due to a water skier. In this case, control circuit 20 is programmed to operate based on only the signal from proximity sensor 30.

The operation of the system may be halted at any time by pressing the stop key 62, which causes the actuator 18 to return to the neutral position of its travel and remain there, resulting in the linkage from hand throttle lever 14 to engine throttle lever 12 behaving in a conventional manner, as though this invention were not present.

I claim:

1. A device for controlling the speed of a motorized watercraft, comprising:

(a) means for measuring the speed of said craft relative to the water over which it travels, consisting of more than one speed measuring device;

(b) control circuit means for comparing the outputs of said speed measuring devices at least frequently, and for using only the highest output of said speed measuring devices as the measured speed;

(c) control means for regulating the speed of the engine of said craft whereby a desired speed of said craft relative to the water may be set and maintained under uniform conditions;

(d) said control circuit means further comparing said measured speed said with said desired speed;

(e) means for actuating said control means to alter the speed of said engine to correct the speed of said craft relative to said water whenever said measured speed varies from said desired speed.

2. A device according to claim 1, wherein said control circuit means:

(a) determines and stores the initial differences between the output signals of said speed measuring devices when operated under similar conditions;

(b) normalizes said output signals of said speed measuring devices operating under said similar conditions so that subsequent readings of said output signals do not reflect said initial differences.

3. A device according to claim 2, wherein said control circuit means:

(a) compares the highest initial output signal of all speed measuring devices to the initial output signal of all other said speed measuring devices when operated under said similar conditions to a maximum allowable value;

(b) subsequently ignores the output signals of all said speed measuring devices which produced an initial output signal lower than said highest initial output signal of all said speed measuring devices by greater than said maximum allowable value.

4. A device according to claim 3, further incorporating a means to signal the operator of said motorized watercraft whenever said control circuit means detects that any of said initial output signals of said speed measuring devices differs from said highest initial output signal of all said speed measuring devices by greater than said maximum allowable value.

5. A device according to claim 4, further incorporating a means to inform the operator of said motorized watercraft which of said speed measuring devices in particular was determined by said control means to have initially produced said output signal differing from said highest initial output signal of all speed measuring device by greater than said maximum allowable value.

6. A device according to claim 1:

(a) further incorporating means for measuring the force on said craft applied by a water skier;

(b) wherein said control circuit means actuates said control means to alter the speed of said engine to prevent or minimize a change in the speed of said craft relative to said water whenever said force is applied to said craft by said water skier, with said actuation of said control means taking place in addition to said actuation of said control means to correct the speed of said craft relative to said water whenever said measured speed varies from said desired speed.

7. A device for controlling the speed of a motorized watercraft, comprising:

(a) means for measuring the force on said watercraft applied by a water skier;

(c) control means for regulating the speed of the engine of said craft whereby a desired speed of said craft relative to the water may be set and maintained under uniform conditions;

(d) means for actuating said control means to alter the speed of said engine to prevent or minimize a change in the speed of said craft relative to said water due to said force applied by said water skier.

* * * * *